US006173118B1

(12) United States Patent
Harris

(10) Patent No.: US 6,173,118 B1
(45) Date of Patent: Jan. 9, 2001

(54) SENSOR BLOCK AND AUTOMATIC FILL VALVE FOR WATER WITH IMMERSED COPPER FLUID COIL

(75) Inventor: Howard Harris, Ashland City, TN (US)

(73) Assignee: Howard Harris Building Inc., Ashland City, TN (US)

( * ) Notice: Under 35 U.S.C. 154(b), the term of this patent shall be extended for 0 days.

(21) Appl. No.: 09/333,261

(22) Filed: Jun. 15, 1999

(51) Int. Cl.[7] ..... F24H 1/10; F24H 1/20

(52) U.S. Cl. ..... 392/451; 392/481; 392/496; 126/344

(58) Field of Search ..... 392/451, 455, 392/456, 479, 480, 481, 484, 496; 126/362; 165/132, 144, 156, 163, 104.19

(56) References Cited

U.S. PATENT DOCUMENTS 1,560,528 * 11/1925 Baum ..... 392/456
2,748,249 * 5/1956 Collerati ..... 392/456
5,228,413 * 7/1993 Tam ..... 122/17
5,438,642 * 8/1995 Posen ..... 392/485
5,485,879 * 1/1996 Lannes ..... 165/70
5,626,287 * 5/1997 Krause et al. ..... 236/20 R
5,838,879 * 11/1998 Harris ..... 392/451

* cited by examiner

*Primary Examiner*—Teresa Walberg
*Assistant Examiner*—Thor Campbell
(74) *Attorney, Agent, or Firm*—Shanks & Herbert

(57) ABSTRACT

A pressureless electric water heater for domestic use has a cylindrical double-walled tank for holding a quantity of a heat transfer liquid such as water. Cold water enters a copper coil immersed in the heat transfer liquid. The heat transfer liquid is heated by an electric heating element which extends down from a hinged tank top. Cold water flowing through the immersed coil is heated by the heat transfer liquid and exits the coil as hot water. The hinged top allows easy access to the interior of the tank and to the heating element, further easing access and replacement thereof. Sedimentation in the tank is minimized because the tank water is rarely replaced. Sedimentation in the coil is reduced because pressurized water flows through the coil when hot water is required and continuously cleanses the tubing. A sensor block is used to activate the heating element whenever water is introduced into the coils. An automatic fill valve maintains the tank level. A top-nesting container can hold the heating element and thermostat, allowing for easier repairs.

14 Claims, 8 Drawing Sheets

SENSOR BLOCK AND AUTOMATIC FILL VALVE FOR WATER WITH IMMERSED COPPER FLUID COIL

CROSS-REFERENCE TO RELATED APPLICATIONS

This application is related to application Ser. No. 08/579,424, filed Dec. 27, 1995, now U.S. Pat. No. 5,838,879, the disclosure of which is incorporated herein by reference.

BACKGROUND OF THE INVENTION

1. Technical Field

This invention relates generally to electric water heaters for domestic use. More particularly, this invention relates to a compact electric water heater for domestic uses which is pressureless and continuously self-cleaning. The water heater preferably includes one or more of an automatic fill switch, an inlet temperature sensor block and top-nesting container for mounting the electric heating element and thermostat.

2. Background Art

The typical electric domestic water heater consists of a steel tank, insulated by fiberglass encased in a metal jacket. Cold water runs into the steel tank, is heated by lower and upper heating elements, and exits through a pipe. As hot water is drained off, cold water mixes with the remaining hot water, reducing the temperature of the remaining water.

Also, in a conventional electric water heater, minerals typically settle out from the water to form sediments, eventually reducing the heater's efficiency and causing corrosion and leaks. In addition, pressure is generated in the tightly sealed tank from heat and from occasional excessive water pressure entering the system from the cold water source. This pressure occasionally results in property damage and personal injury from steam and water leaving the pressure relief valve or from explosion from a failed valve.

The heating elements in conventional electric water heaters often fail before the tank and must be replaced. Because of the design of prior art domestic electric water heaters, replacement of the elements is a difficult task, usually requiring that the water supply be shut off and the tank drained prior to replacing the element.

SUMMARY OF THE INVENTION

One object of the electric water heater of this invention is to eliminate pressure inside the tank. This is accomplished by running the pressurized cold water that is to be heated through a copper coil. The copper coil which carries the cold water is immersed in a pressureless tank filled with a non-recirculating heat transfer fluid such as water. The water in the tank is heated by, for example, an electric heating element. The heated tank water heats the copper coils which are thermally conductive. The pressurized cold water, i.e., tap water from a water supply, is heated as it circulates through the coils by thermal conductivity. Thus, cold water enters the coils, indirectly absorbs heat from the heated tank water, and exits the coils as hot water.

In the pressureless tank of this invention, new sediment is rarely added to the tank because the tank water is rarely replaced. Thus, sediment buildup is reduced. The coil is continuously cleaned by the pressurized water running through it.

Because the tank of the water heater of this invention is not pressurized, the interior of the tank can be accessed without shutting off the water supply and draining the tank. Such access is required to replace a failed element.

In a preferred embodiment of the invention, the water heater comprises a double-walled cylindrical tank formed of plastic. The space between the inner and outer walls of the tank is insulated with foam. Water is heated in the tank by means of an electric heating element. Continuous copper coils are placed in the tank through which cold water enters and hot water exits. An optional overflow pipe, if present, the cold water inlet, and the hot water outlet are located above the water level of the tank in an air space below the top of the tank so that there are no holes in the tank to develop leaks. A float valve admits tank make-up water to the tank from the cold water inlet when the level of water in the tank falls below a minimum tank fill level. The float valve discontinues the flow of water into the tank from the cold water outlet when the level of water in the tank reaches a full level. The heating element is mounted on a heating element mount which is inserted through a hole in the tank's top. The mount extends and protrudes down into the water located in the tank. The heating element is controlled by a thermostat in contact with a sensor block placed in the incoming cold water line. The sensor block detects the circulation of cold water and triggers the thermostat, activating the heating element whenever water is added to the coil.

The continuously cleaned hot water heater of this invention will further provide increased hot water more efficiently in a smaller and lighter tank. This will reduce energy usage, material costs, shipping and storage cost.

DESCRIPTION OF THE PREFERRED EMBODIMENT

Figure 1:
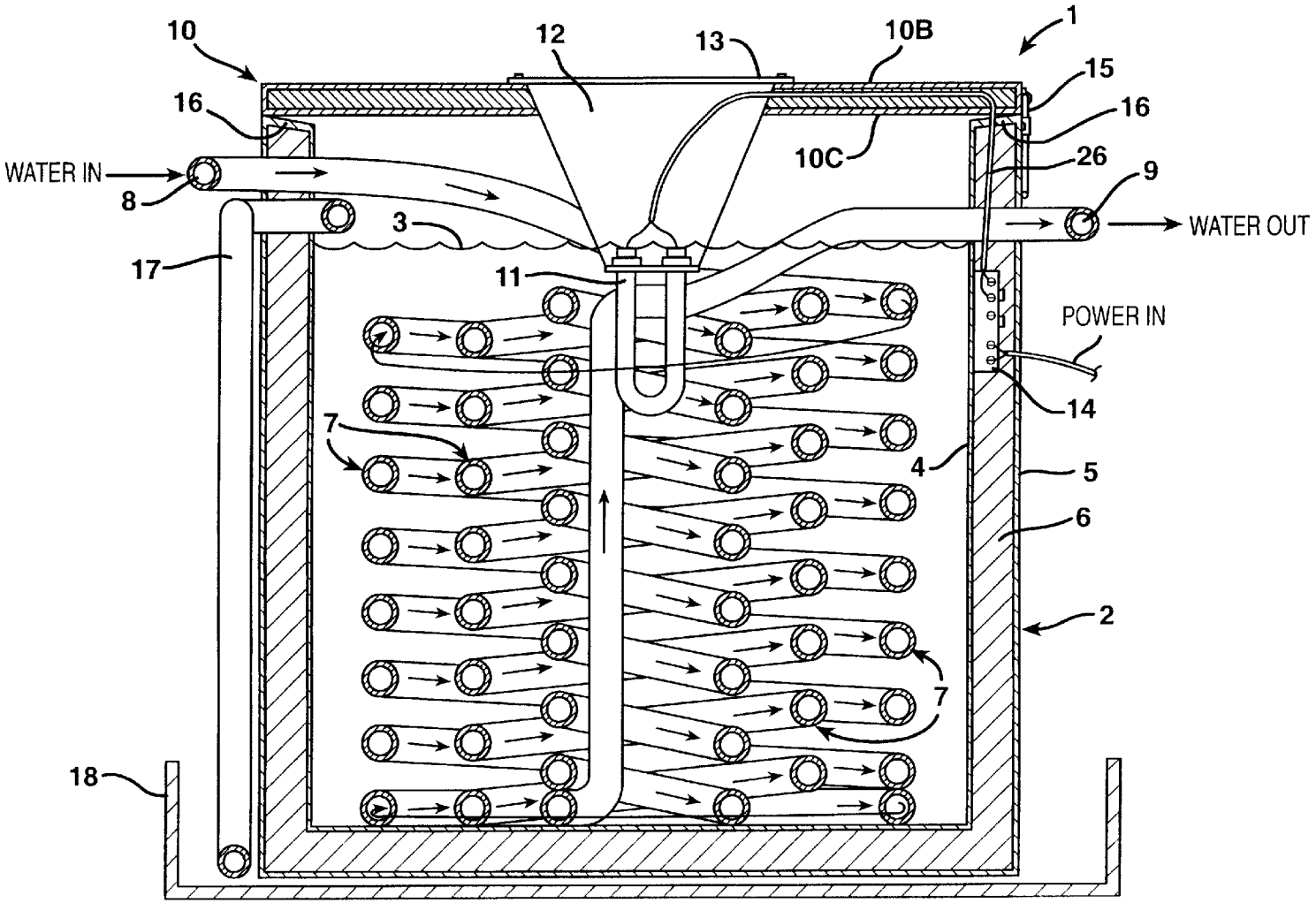
FIG. 1 is a cross sectional side view of the water heater of this invention, showing the hinged top in the closed position.

Applicant's invention will be best understood when considered in light of the following description of a preferred embodiment of the invention as illustrated in the attached drawings wherein like reference numerals refer to like parts.

The design of the continuously cleaned pressureless water heater, generally indicated by the reference numeral 1 is shown at FIG. 1. The tank includes a vertically oriented cylindrical tank 2 containing a sufficient quantity of a heat transfer fluid 3 to cover the coil 7. Typically, the heat transfer fluid 3 will be water, but could be a different heat transfer fluid. The tank 2 is preferably formed with an inner wall 4 and an outer wall 5. The inner and outer walls may be spaced approximately two inches apart, but any convenient spacing may be chosen. The space between the walls 4 and 5 preferably is filled with a thermal insulation material, e.g., foam thermal insulation 6.

Figure 2A:
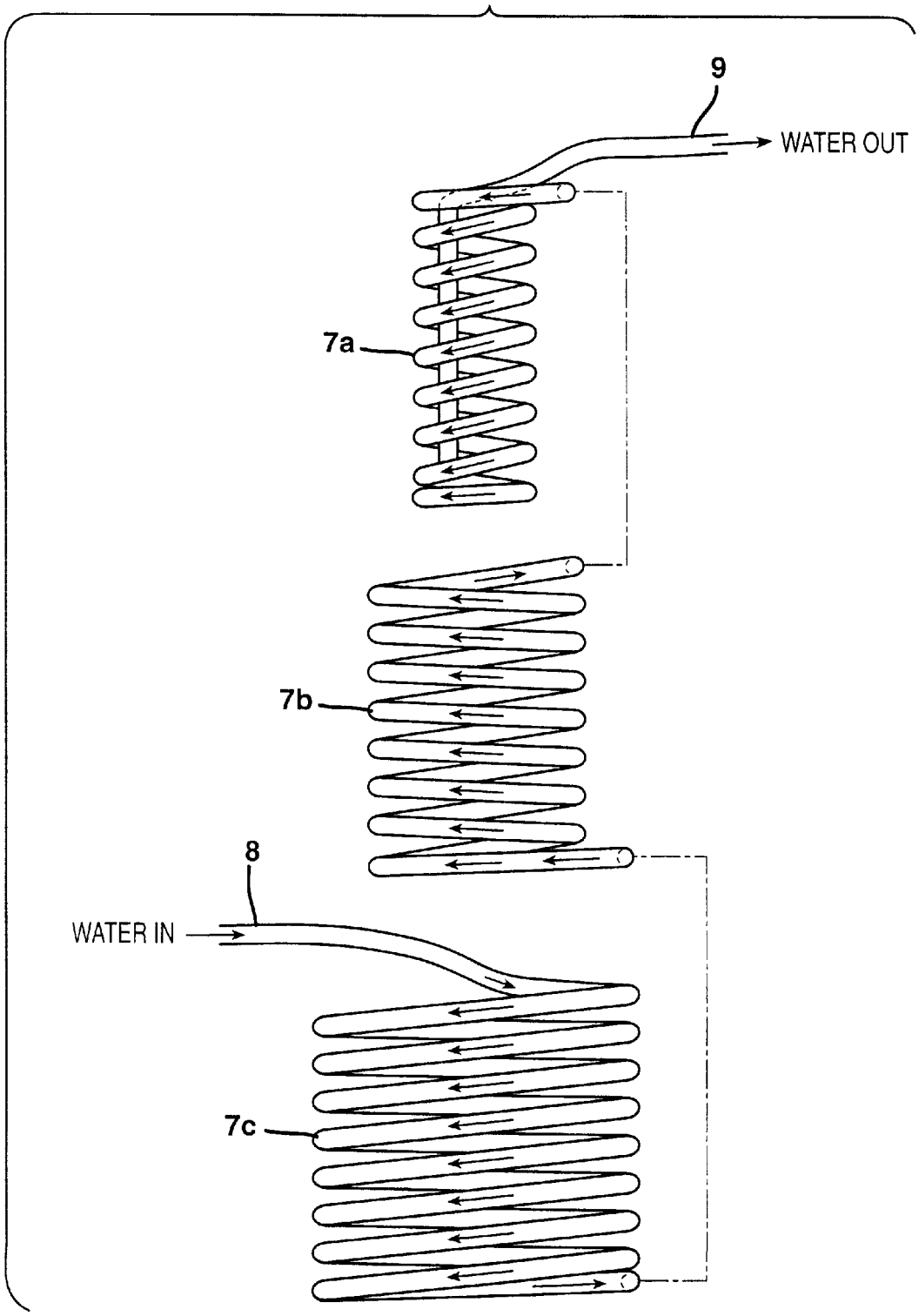
FIG. 2A is an exploded side view of the normally nested and interconnected coils used in the water heater of FIG. 1.
Figure 2B:
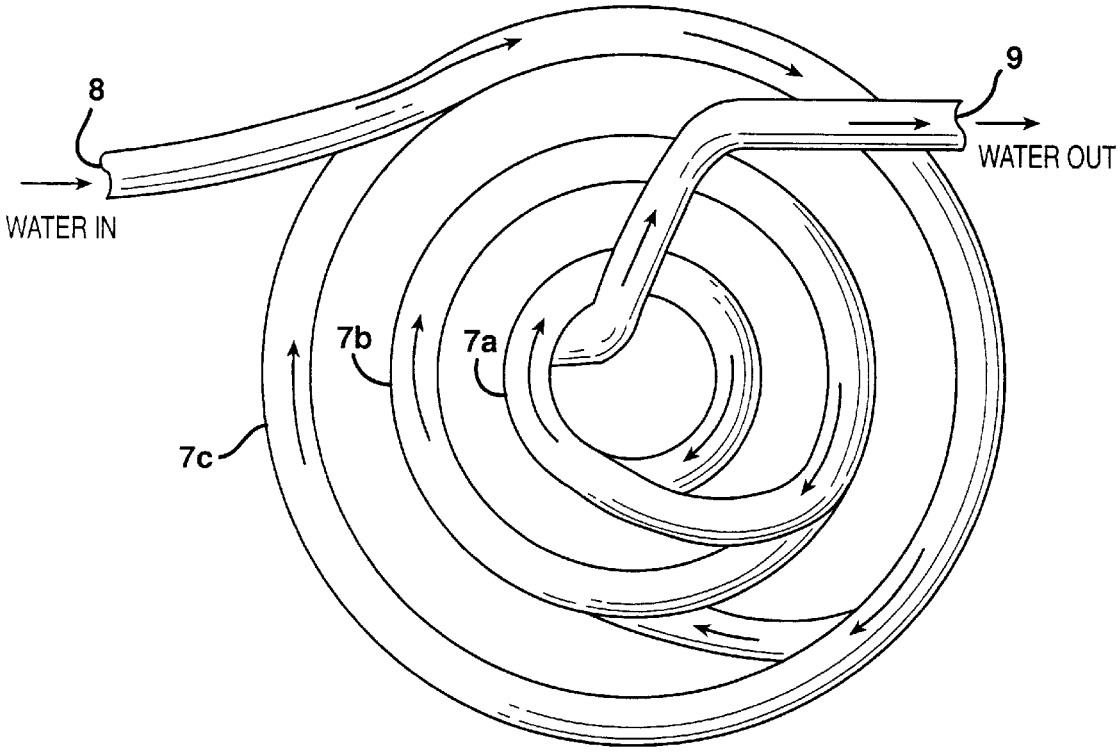
FIG. 2B is a top view of the coils shown in FIG. 2A, but in their nested and interconnected positions as shown in FIG. 1.

Positioned inside the tank 2 is a coil 7 of continuously connected tubing, e.g., copper tubing. As seen best in FIGS. 2A and 2B, the coil 7 is preferably formed of multiple coil sections 7*a*, 7*b*, and 7*c* with each coil section 7*a–c* having a progressively increasing outside and inside diameter so that they can be nested and interconnected, as shown in FIG. 1. In a preferred embodiment, coil 7 will be formed of approximately 300 linear feet one-half inch OD copper tubing. The cold water to be heated inside the tank 2 enters the coil 7 at a cold water inlet 8, circulates through each coil section 7*a–c* successively, and exits the coil through the hot water outlet 9. The direction of water flow is indicated by directional arrows into the water inlet 8, along the outer surface of the coil 7 and out of the water outlet 9.

Figure 9:
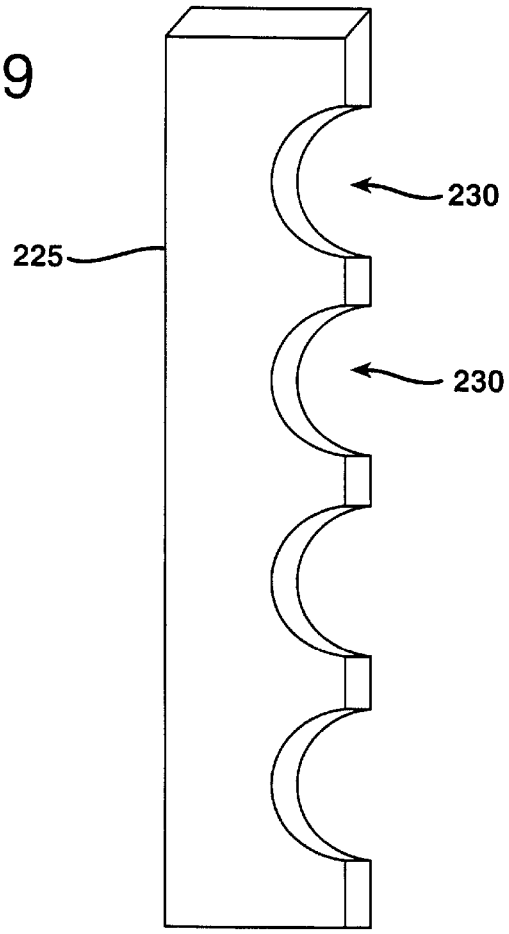
FIG. 9 is a view of coil spacers used to vertically separate adjacent portions of the coil.

Coil clips 225 may be used to maintain the even spacing of the coil of tubing. As shown in FIG. 9, the coil clips are formed from long narrow strips of packing material, e.g., Styrofoam® brand multicellular expanded synthetic resins with circular indents 230 along one edge of the material to hold the tubing in place. Each coil section is preferably supported by three coil clips.

Looking again at FIG. 1, a double-walled top 10, preferably made of insulated plastic, supports a conventional electric heating element 11 that is secured to the top 10 and extends downward inside the tank 2 and beneath the surface of the tank water 3. The heating element 11 could be any conventional electric water heater element, for example, a Camco Electric Water Heater Element #02363. The heating element 11 may be attached to a conical plastic mount 12, which extends through the top 10, and which may be fastened to the top 10 by a screw-in plate 13. A thermostat 14, also of conventional design such as a Camco Electric Water Heater Thermostat #07845, can be electrically connected by a control wire 16 which runs upwardly between the inner and outer walls 4 and 5 of the tank 2 and across inside the walls of the top 10. The thermostat controls electric power to the heating element 11 for regulation of the temperature of the tank water 3.

Figure 5:
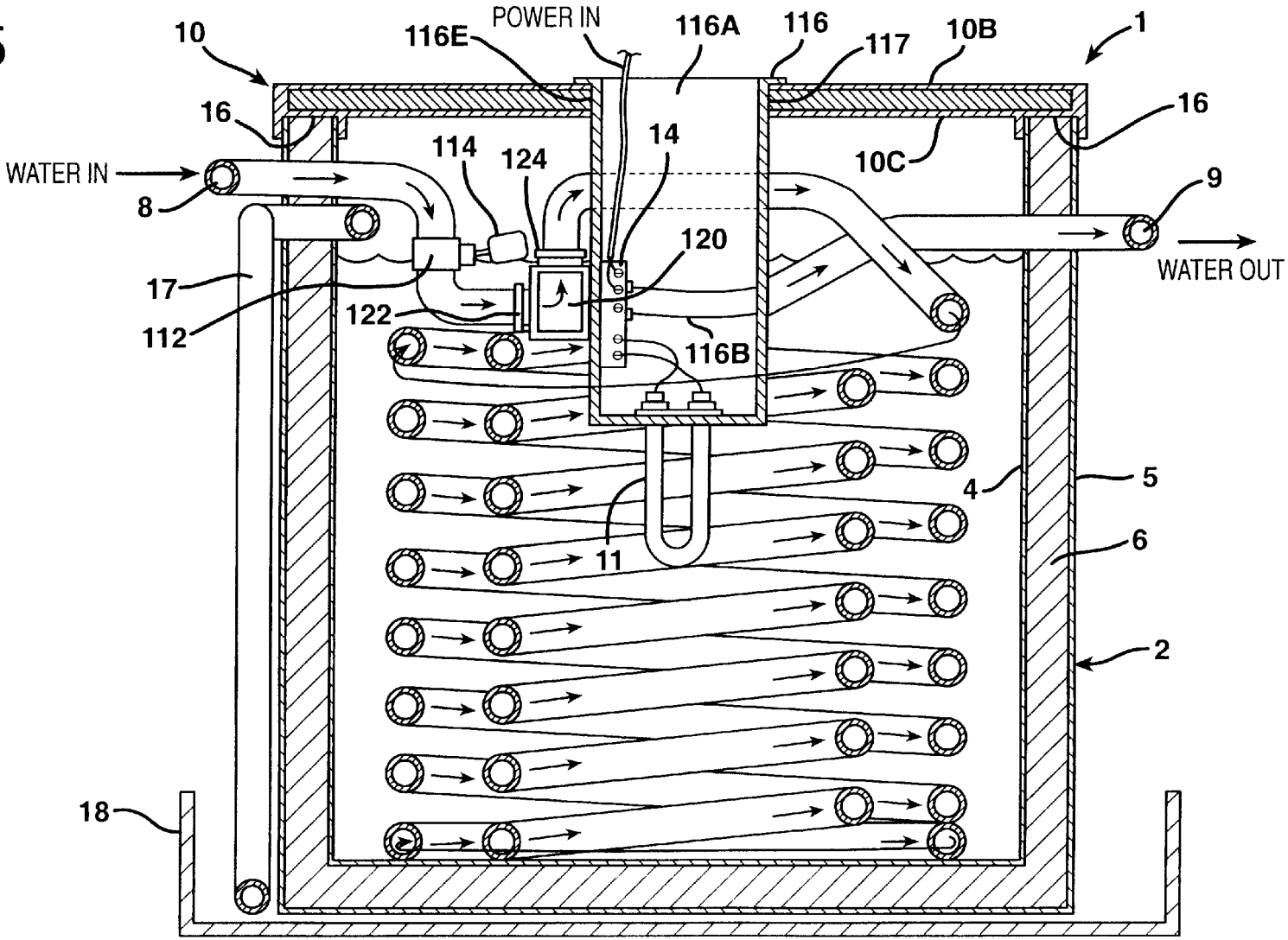
FIG. 5 is a cross sectional side view of the water heater according to another embodiment of this invention.

Alternatively, as shown in FIG. 5, a double-walled top 10, preferably made of insulated plastic, supports a conventional electric heating element 11 that is secured to a heating element mount 116 and extends downward inside the tank 2 and beneath the surface of the tank water 3. The mount 16 is inserted through a hole in top 10, and may be held in place by a lip that is larger than the hole. A thermostat 14, also of conventional design, can be mounted on one side of the heating element mount 116, in thermal proximity to a sensor block 120 in the coil line. The thermostat 14 controls electric power to the heating element 11 for regulation of the temperature of the tank water 3.

Figure 3:
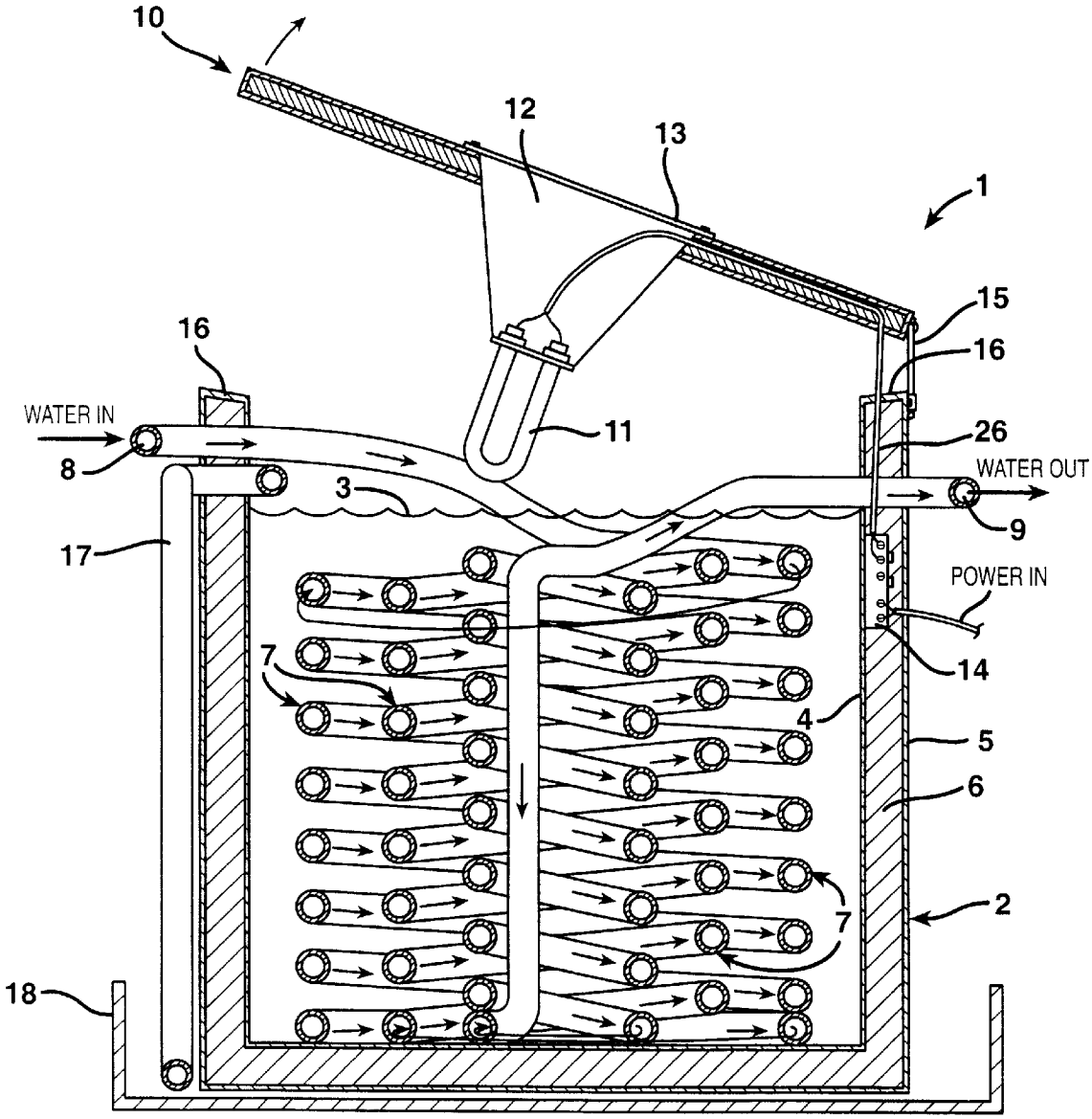
FIG. 3 is a cross sectional side view of the water heater of FIG. 1, showing the hinged top in the open position.

In accordance with another aspect of the invention, the top 10 may be attached to the tank 2 on one side by a hinge 15 so that the top 10 can be separated from the tank outer wall 5 by moving it from a closed position as shown in FIG. 1 to an open position as shown in FIG. 3. When the top 10 is in the open position, the heating element 11 can be easily accessed and replaced without having to shut-off the water supply or drain the tank 2. Almost any conventional hinge type can be used, with one example shown in FIG. 4 in which hinge 15 allows for both vertical and pivoting separation of the top 10 from the tank outer wall 5.

In accordance with another aspect of the invention as shown in FIG. 5, a water heater 1 has a top 10 which includes a center hole 117. A heating element mount 116 descends through the hole into the tank water, preferably positioning the heating element 11 at approximately the center of the tank. A plastic lid to cover the hole is preferably insulated to limit heat loss through the center hole. A thermostat 14 is preferably attached in close thermal contact with an inner wall of the mount 116. The outer wall of the container fits tightly against a sensor block 120. The coil 7 is attached to a sensor block 120 which receives the first influx of cold water. Because of the thermostat's position against the sensor block 120, the heating element 11 will begin heating, raising the water temperature in the tank while water is being extracted from the coils 7. Timing the heating to coincide with use raises the efficiency of the water heater.

As shown in FIG. 5, the lid 10 can simply rest on top of the walls 4, 5 of tank 2. Preferably, the lid 10 screws down onto the tank 2 by one or two pairs of mating threads (not shown) on the lid 10 and the inner wall 4 and/or outer wall 5.

Figure 6:
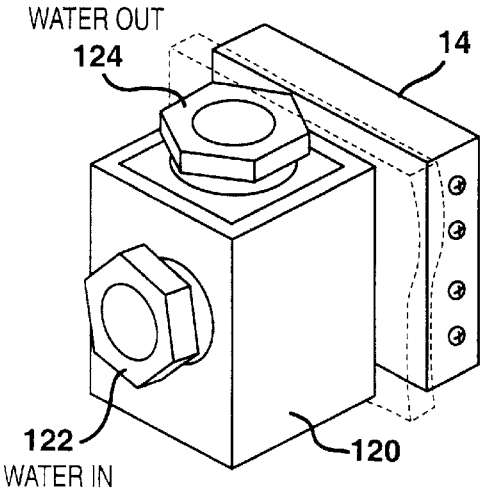
FIG. 6 is a perspective view of a first sensor block configuration.
Figure 7:
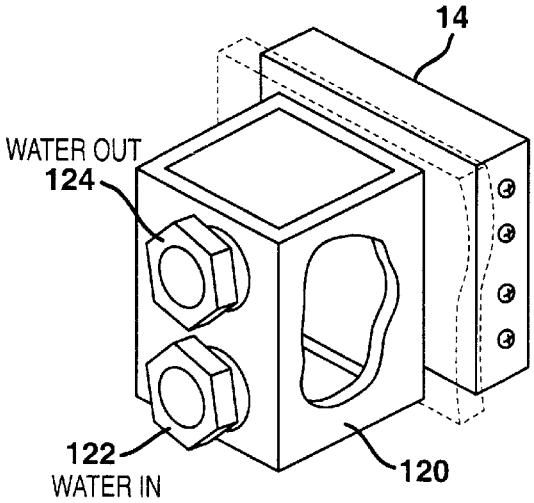
FIG. 7 is a perspective view of a second sensor block configuration.
Figure 8:
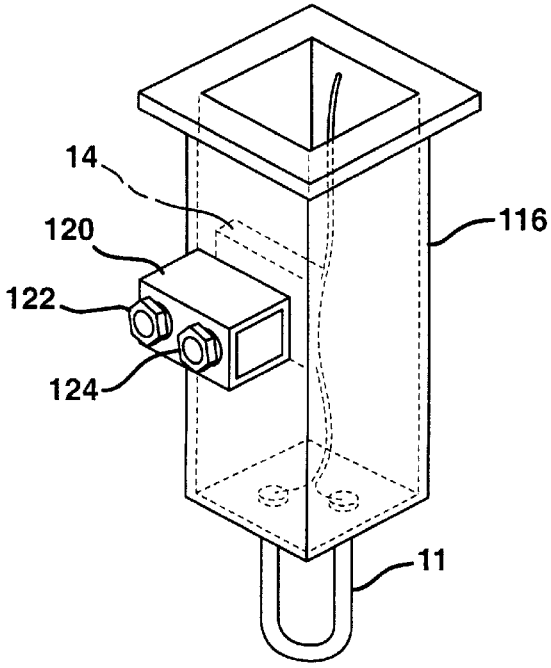
FIG. 8 is a perspective view of the heating element mount, a third sensor block configuration, and thermostat.

The sensor block 120 is a hollow block through which the incoming cold water flows before passing through the coiled section. The sensor block 120 is placed in close proximity with the thermostat 14. The sensor block should preferably be perfectly aligned with the thermostat to improve the thermal contact between the devices. As hot water is drawn, cold water circulates through the in-line sensor block 120, thereby cooling the thermostat 14. The sensor block 120 could be configured in various ways to allow the flow of water as shown in FIGS. 6–8. In particular, the connectors 122 and 124 for bringing water through the sensor block 120 may be positioned on different faces of the sensor block 120 as shown in FIG. 6, on the same face positioned vertically as shown in FIG. 7 or horizontally as shown in FIG. 8. The sensor block 120 preferably is made of any thermoconductive metal. Thermostat 14 is held tightly fitted by the mount 116 against sensor block 120. A tension plate would preferably be used to hold the sensor against the center block.

Figure 10:
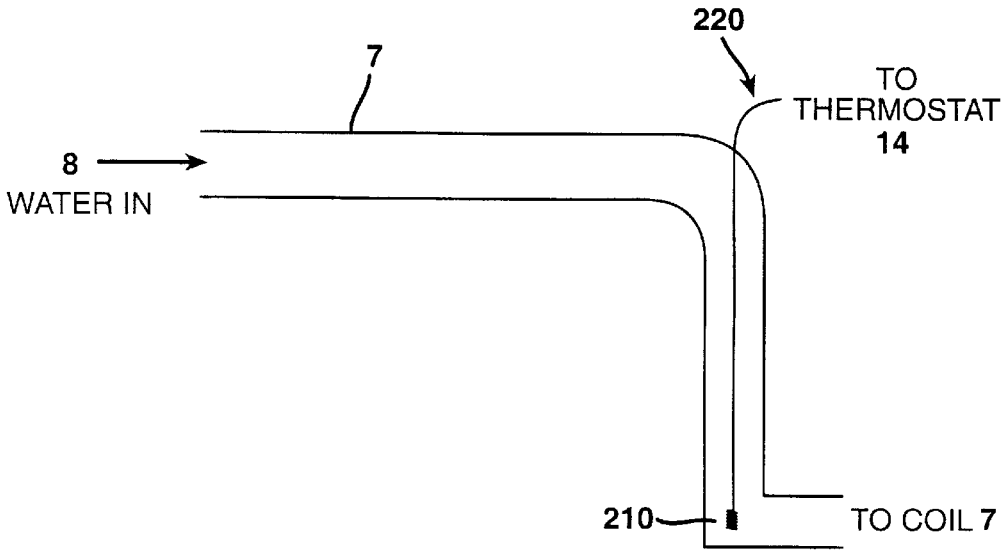
FIG. 10 is a view of the position of the temperature sensor in one embodiment of the invention.

In accordance with an another aspect of the invention, as shown in FIG. 10, a temperature sensor 210, e.g., a thermocouple, is placed inside the tubing 7 near the coil water intake 8. A wire 220 passing through the tubing, preferably at a point above the level of fluid in the tank, connects the sensor 210 to the thermostat 14. In this embodiment, the thermostat could be mounted in the heating element mount, between the inner and outer wall, or at some other convenient place. When the temperature of the water in the coil drops below a predetermined temperature, for example 140° F., the thermostat activates the electric heating element, thereby heating the water in the tank.

A float 114 is attached to the incoming cold water line S. The float measures the water level in the tank and fills the tank through valve 112 automatically when the water level in the tank falls below the necessary level. In a preferred embodiment, the float valve is attached to an in-line T joint pipe.

Figure 4:
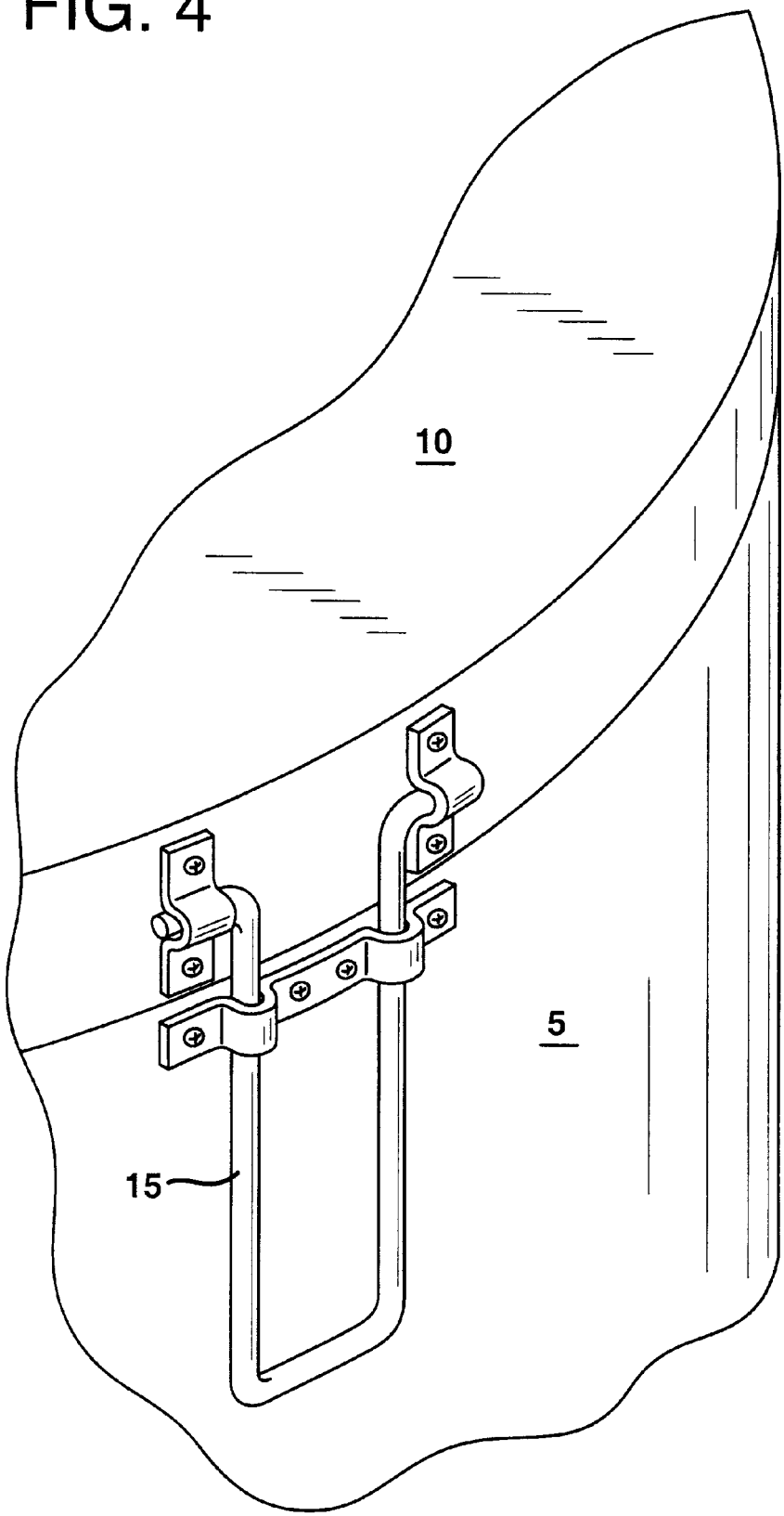
FIG. 4 is an enlarged perspective view of a section of the tank side wall and top of the water heater of FIG. 1, showing the connecting hinge

FIG. 4. shows a heating element mount 116 in accordance with one embodiment of the invention, including water heater, sensor block 120 connectors 122 and 124 and thermostat 14. By locating the thermostat 14 inside the mount 116 and heating element 11 on the mount 116, accessing the heating element 11 and thermostat 14 for replacement or repair is simplified. The lid 10 in this embodiment can be left in place when repairs are necessary, leaving the water supply connections undisturbed.

As seen in FIGS. 1 and 3, an optional overflow pipe 17 may be located in the air space between the top surface of the tank water 3 and the top 10. The overflow pipe 17, if present, runs to an overflow pan 18 in which the water heater 1 sits.

In one test performed, using less efficient materials than those described, twenty gallons of cold tap water (temperature not measured) were placed in the tank 2. The coil 7 consisted of 300 feet of ½ inch OD copper tubing. The thermostat 14 was set at 150 degrees. The tank water 3 was heated with one 4500 watt heating element 11. The water preheated for forty-five minutes. Forty gallons of water was then continuously drawn from the heater 1 with results as follows 1. First five gallons—140 degrees
2. Second five gallons—125 degrees
3. Third five gallons—120 degrees
4. Fourth five gallons—115 degrees
5. Fifth five gallons—110 degrees
6. Sixth five gallons—105 degrees
7. Seventh five gallons 102 degrees
8. Eighth five gallons—98 degrees (3¼ Kilowatts Used)

Thus, although there have been described particular embodiments of the present invention of a new and useful water heater, it is not intended that such references be construed as limitations upon the scope of this invention except as set forth in the following claims.

What is claimed is:

1. An electric water heater comprising:

a. a water tank having a wall, a bottom and a tank top, the tank top adapted to be separated from the wall, the water tank adapted to hold a quantity of non-pressurized and non-circulating heat transfer liquid up to an upper liquid level that is below the tank top, to define an air gap region inside the tank between the upper liquid level and the top;

b. a thermally conductive coil mounted inside the tank and having a water inlet and a water outlet that each extend outwardly through the tank wall, whereby the tank top can be separated from the tank wall independently of the water inlet and water outlet;

c. an electric heating element attached to the tank top and extending downwardly through the air gap region in the tank and below the upper liquid level;

d. a sensor block receiving water from the coil and returning water to the coil;

e. a thermostat in thermal proximity with the sensor block, where the thermostat activates the electric heating element when the water temperature in the sensor block changes; and f. whereby the electric heating element contacts and heats the heat transfer liquid inside the tank and whereby the heat transfer liquid contacts the coil to heat water from a domestic water supply that enters the water inlet and circulates through the coil such that heated water leaves the water outlet and returns to the domestic water supply.

2. The water heater of claim 1 wherein the sensor block is made of a thermoconductive metal.

3. The water heater of claim 1 wherein the tank top includes a center hole which can receive a mount attached to the electric heating element and the thermostat.

4. The water heater of claim 3 wherein the mount is rectangular.

5. The water heater of claim 1, further comprising an automatic fill valve.

6. The water heater of claim 5, wherein the automatic fill valve is a float valve.

7. The water heater of claim 1 wherein the tank wall comprises an inner tank wall and an outer tank wall separated by a first gap filled with thermal insulation.

8. The water heater of claim 7 wherein the inner and outer tank walls are made of a plastic material.

9. The water heater of claim 1 wherein the tank top has double-walls separated by a second gap filled with thermal insulation.

10. The water heater of claim 9 wherein the double walls of the tank top are made of a plastic material.

11. The water heater of claim 1 wherein the heat transfer fluid is water.

12. The water heater of claim 2 where the thermostat is electrically connected to the heating element by a control wire, the thermostat and a portion of the control wire are positioned inside the mount.

13. The water heater of claim 1 further comprising maintaining even spacing between the coils by fixing coil clips to the coil.

14. An electric water heater comprising:

a. a water tank having a wall, a bottom and a tank top, the tank top adapted to be separated from the wall, the water tank adapted to hold a quantity of non-pressurized and non-circulating heat transfer liquid up to an upper liquid level that is below the tank top, to define an air gap region inside the tank between the upper liquid level and the top;

b. a thermally conductive coil mounted inside the tank and having a water inlet and a water outlet that each extend outwardly through the tank wall, whereby the tank top can be separated from the tank wall independently of the water inlet and water outlet;

c. an electric heating element attached to the tank top and extending downwardly through the air gap region in the tank and below the upper liquid level;

d. a sensor measuring the water temperature in the coil;

e. a thermostat connected with the sensor, where the thermostat activates the electric heating element when the measured water temperature changes; and f. whereby the electric heating element contacts and heats the heat transfer liquid inside the tank and whereby the heat transfer liquid contacts the coil to heat water from a domestic water supply that enters the water inlet and circulates through the coil such that heated water leaves the water outlet and returns to the domestic water supply.

* * * * *